US005196891A

United States Patent [19]

Shimazaki et al.

[11] Patent Number: 5,196,891

[45] Date of Patent: Mar. 23, 1993

[54] IMAGE FORMING APPARATUS HAVING DISTRIBUTION BRUSH AND IMAGE CARRIER MOUNTED IN A REMOVABLE UNIT

[75] Inventors: Takashi Shimazaki; Seiichiro Fushimi, both of Tokyo, Japan

[73] Assignee: Kabushiki Kaisha Toshiba, Kawasaki, Japan

[21] Appl. No.: 602,376

[22] Filed: Oct. 22, 1990

Related U.S. Application Data

[63] Continuation of Ser. No. 262,842, Oct. 26, 1988, abandoned.

[30] Foreign Application Priority Data

Nov. 2, 1987 [JP] Japan ..... 62-278046

[51] Int. Cl.[5] ..... G03G 13/00

[52] U.S. Cl. ..... 355/269; 355/211

[58] Field of Search ..... 355/211, 296, 269, 270, 355/200; 118/652

[56] References Cited

U.S. PATENT DOCUMENTS

| | | | |
|---|---|---|---|
| 3,617,123 | 11/1971 | Emerson | 355/270 X |
| 4,351,603 | 9/1982 | Tagawa | 355/296 |
| 4,598,993 | 7/1986 | Mizutani et al. | 355/211 |
| 4,664,504 | 5/1987 | Oda et al. | 355/270 X |
| 4,769,676 | 9/1988 | Makai et al. | 355/270 X |

*Primary Examiner*—A. T. Grimley
*Assistant Examiner*—Robert Beatty
*Attorney, Agent, or Firm*—Foley & Lardner

[57] ABSTRACT

In an image forming apparatus has a photosensitive drum, the drum is charged by a main charger. A light beam bearing image information is applied to the drum by an exposure system to form a latent image on the surface of the drum. The latent image is developed by a developing unit, using a toner to form a toner image on the drum surface. The toner image is transfered to the surface of a paper sheet by a transfer charger. The developing unit serves to remove, simultaneously with the development of the latent image, the toner remaining on the drum surface after the transfer by the transfer charger. Before the removing of the remaining toner, the drum is in sliding contact with a brush member. The remaining toner is temporarily attracted to the brush member by the bias voltage applied to the brush member, with the result that the remaining toner becomes easy to separate from the drum. In the apparatus, the drum and at least the brush member are integrated as one process unit. The process unit is removably insertable into a predetermined operative position in the body of the apparatus. Accordingly, when the drum is removed from the operative position, the toner attracted to the brush member is prevented from scattering in the body by removing the brush member with the drum.

3 Claims, 5 Drawing Sheets

IMAGE FORMING APPARATUS HAVING DISTRIBUTION BRUSH AND IMAGE CARRIER MOUNTED IN A REMOVABLE UNIT

This application is a continuation of application Ser. No. 07/262,842, filed Oct. 26, 1988 now abandoned.

BACKGROUND OF THE INVENTION

1. Field of the Invention

The present invention relates to an image-forming apparatus which may be used in various devices such as, for example, laser printers, copy machines, fax machines, etc, which form an image on a reusable image carrier.

2. Description of the Prior Art

The image-forming apparatus of the prior art includes a photosensitive drum which is rotated in a predetermined direction. The drum is surrounded by a main charger, an exposure section of an exposure system, a developing unit, a transfer charger, a separation charger, a cleaner, and a de-electrifier, all of which are arranged successively in the rotating direction of the drum.

To form an image on a sheet of paper, the surface of the photosensitive drum is initially uniformly charged by the main charger. The charged surface is exposed by the exposure system. The exposure system may be an optical system such as that in a copier, a laser-optical system such as in a laser printer, etc. to form an electrostatic latent image on the drum surface of the photosensitive drum. After the latent image is formed on the drum, toner is applied to the surface of the drum by the developing unit. As a result, the latent image becomes visible. In other words, it is developed into a toner image. Then, the toner image is transferred, by the transfer charger, to the surface of a paper sheet, which is brought into contact with the surface of the drum. After the toner image is transferred to the paper, the paper sheet is separated from the drum by the separation charger.

Those toner particles remaining on the surface of the photosensitive drum, not having been transferred to the sheet surface, are removed by the cleaner. Thereafter, the electrostatic latent image on the surface of the drum is erased to complete one cycle of image formation.

Conventionally, the residual toner particles on the surface of the photosensitive drum are scraped from the drum surface by a blade attached to the cleaner. The scraped toner is collected in the cleaner. Usually, the internal space of the cleaner is filled with toner after 2,000 to 3,000 sheets of paper are printed. As a result, the cleaner becomes unusable.

Image-forming apparatuses with the above described construction include these designed so that a cleaner full of scraped toner particles can be discarded, along with the photosensitive drum when the drum is replaced. These "expendables" are expensive however. In the case of frequently used apparatuses, such as printers, there is significant "down time" during replacement of the cleaner and the drum. Therefore, such apparatuses are not preferred by purchasers.

In some prior art image-forming apparatuses, a toner conveyor screw for toner recovery is provided within the cleaner. The screw conveys toner from the cleaner to a toner recovery box outside the cleaner, thereby recovering it. Because the recovery box is located inside the apparatus, it must be fairly small. After the image is formed on several thousand sheets, therefore, the box must be replaced with a new one. At the time of removal of the box, some of the toner may spill, thereby soiling the operator's hands or clothes, or the floor.

Another problem with this conventional arrangement is that the blade of the cleaner is brought into contact with the surface of the photosensitive drum. Sometimes, the surface of the drum is scratched by the blade.

An OPC (organic photoconductor) photosensitive drum is generally safe and harmless to use. However, due to its softness, the drum has a very short life. If the photosensitive drum has a small diameter, in particular, it must rotate many times to record on each paper sheet. Accordingly, the same portion of the drum must be used so frequently for printing each sheet that the life and replacement cycle of the drum are inevitably short. It is not advisable, therefore, to use a small diameter photosensitive drum. Thus, the apparatus cannot be easily reduced in size.

In an effort to overcome these operational problems, image-forming apparatuses without cleaners have been developed. Such a device is discribed in U.S. Pat. No. 4,664,504 issued on May 12, 1987, the teachings of which are incorporated herein by reference. In the device described in U.S. Pat. No. 4,664,504, the developing unit also has a cleaning function; that is, image development and cleaning are effected simultaneously by means of the developing unit.

In the image forming apparatuses of this type, however, defective cleaning occurs; therefore, a previous image formed by the process corresponding to the preceding revolution of the photosensitive drum appears in a present image on a paper sheet.

Accordingly, a brush member is brought into contact with the photosensitive drum, to remove the previous image from the photosensitive drum. The brush member is separately placed from the developing unit to reduce the size of the developing unit. But, when the brush member is replaced with a new one, some of the toner attracted to the brush member may spill, thereby soiling the operator's hands or clothes, or the floor.

SUMMARY OF THE INVENTION

The object of the present invention is to provide an image forming apparatus that can be made smaller and lighter than conventional arrangements without a toner recovery box, obviating the possibility of soiling, and allowing an image carrier to have a longer useful life.

Another object of the present invention is to reduce the maintenance needed for an image forming apparatus.

The present invention provides an image-forming apparatus which comprises means for forming a charged pattern corresponding to the image on the image carrier; means for simultaneously developing the charged pattern with developing agent into a developed image on the image carrier and removing developing agent remaining on the image carrier from a previous image forming operation from portions of the image carrier other than the developed image; means for transferring any developing agent remaining on the image carrier after the transfer of the developed image; and means for mounting at least the image carrier and distributing means together in the apparatus as a single removable unit.

According to this arrangement, the developing agent remaining on the surface of the carrier is removed simultaneously with development of the image by electrical and mechanical attraction using the developing means. Therefore, the apparatus can be reduced in size and weight without requiring use of a toner recovery box, cannot soil anything, allows the image carrier to have a longer useful life, and prevents developing agent from spilling at the time of the removal of the distributing means.

DETAILED DESCRIPTION OF THE PREFERRED EMBODIMENTS

Figure 1:
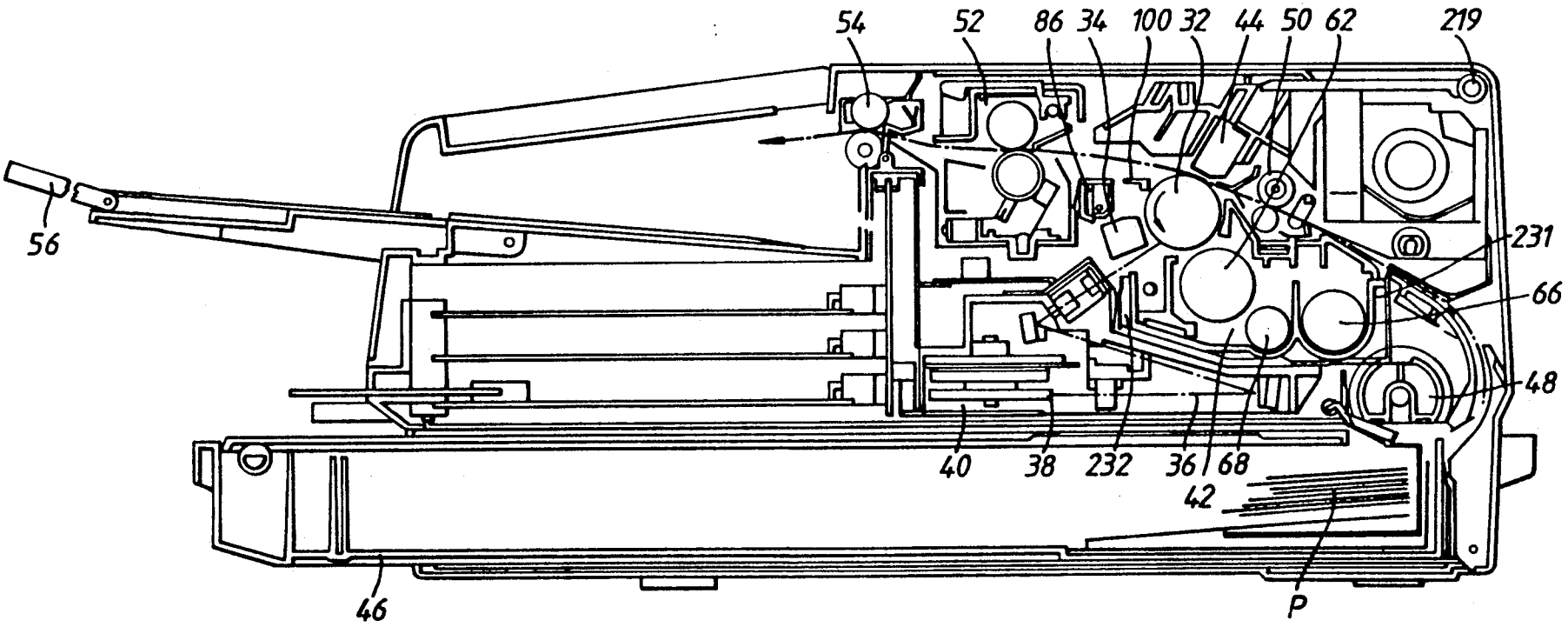
FIG. 1 is a sectional view schematically showing an image-forming apparatus according to the present invention incorporated into a laser printer.

FIG. 1 shows a laser-beam printer as an image-forming apparatus according to the present invention. The laser printer utilizes a semiconductor laser. Even though the invention is described in the context of a laser-beam printer, as a matter of convenience, the invention is not limited to laser printers. It is applicable to copy machines, fax machines, etc.

The laser printer, when being used, is connected to a host system (not shown), e.g., a word processor via a cable and interface (not shown). Print signals are provided by the host system. In response to these print signals, the printer forms an image.

When a print start signal is provided by the host system to the printer, photosensitive drum 32 is rotated. First, the surface of drum 32 is charged electrically by main charger 34. Dot image data is then supplied from the host system to the printer, and laser beam 36, modulated in accordance with the data, is emitted from optical system 40, including polygon scanner 38, and is guided to the drum surface. The charged drum is exposed to, and scanned by laser beam 36. Thereupon, an electrostatic latent image is formed on the surface of drum 32. Then, toner is applied to the latent image by means of developing device 42. As a result, the latent image becomes visible, i.e. it is developed into a toner image. The toner image is transferred to the surface of paper sheet P by transfer charger 44 at a transfer section. Sheet P is fed from sheet cassette 46 to the transfer section by means of paper-supply roller 48 and a pair of aligning rollers 50. After the transfer, sheet P, with the toner image thereon, is delivered to a pair of fixing rollers 52. The toner image is fixed on the surface of sheet P by means of rollers 52. Then, sheet P is discharged onto tray 56 by a pair of exit rollers 54.

After the transfer of the toner image, in order to easily remove residual toner t, the surface of drum 32 is in sliding contact with distributing means 100. Residual toner t on drum 32 is distributed and the position of residual toner t on drum 32 is changed thereby. Next, the surface of drum 32 is discharged by de-electrifier 86 to erase the electrostatic latent image thereon. Thus, one cycle of image formation is finished.

Figure 2A:
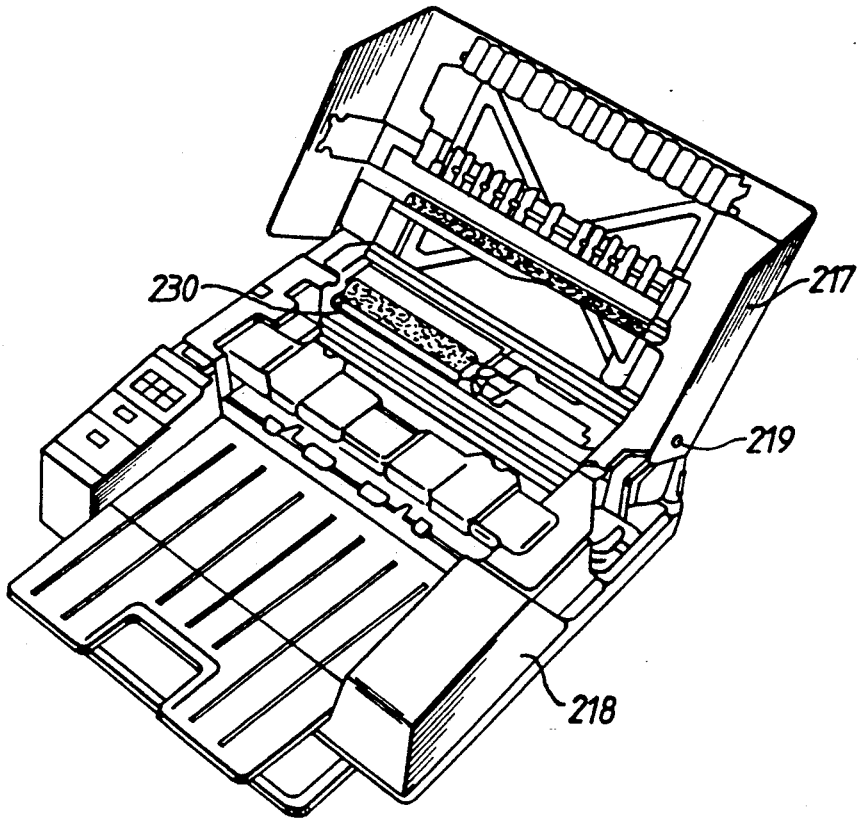
FIG. 2A and 2B are perspective views schematically showing the image forming device according to the present invention.
Figure 2B:
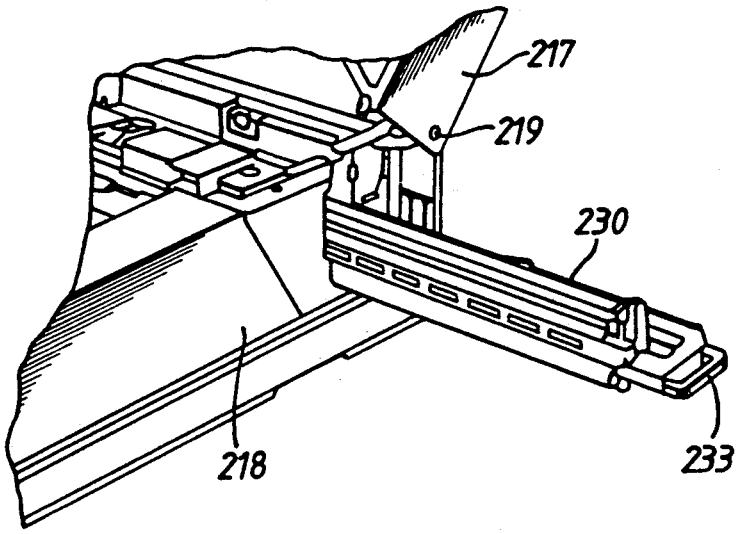

FIG. 2A and 2B shows the printer in its open position. The printer is divided into an upper housing 217 and a lower housing 218, connected with each other by a pivot 219. Upper housing 217 is adapted to rotate upwardly about the pivot 219. Within lower housing 217 is disposed an image forming means which includes optical system 40, photosensitive drum 32, developing device 42, fixing rollers 52, distributing means 100 and other components. On the other hand, upper housing 218 receives transfer charger 44 and other components.

In the illustrated embodiment, the developing device 42, main charger 34, distributing means 100 and other components located around the photosensitive drum 32 are enveloped by housing 58, that is, another housing formed separately from the upper and lower housing to form a process unit 230. If it is desired to replace one of the photosensitive drum 32, developing device 42 or distributing means 100 process unit 230 is changed as a unit. Any maintenance operation is therefore avoided.

The process unit 230 can be mounted in the printer by moving it along rails 231 and 232 located in the printer in the direction parallel to the rotational axis of photosensitive drum 32, as shown in FIG. 1. In the case of removal of process unit 230 from the printer, upper housing 217 is first rotated upwardly to bring the printer into an open position, as shown in FIG. 2A. Process unit 230 is then moved on the rails 231 and 232 along the axis of the photosensitive drum 32 as shown in FIG. 2B.

Figure 3A:
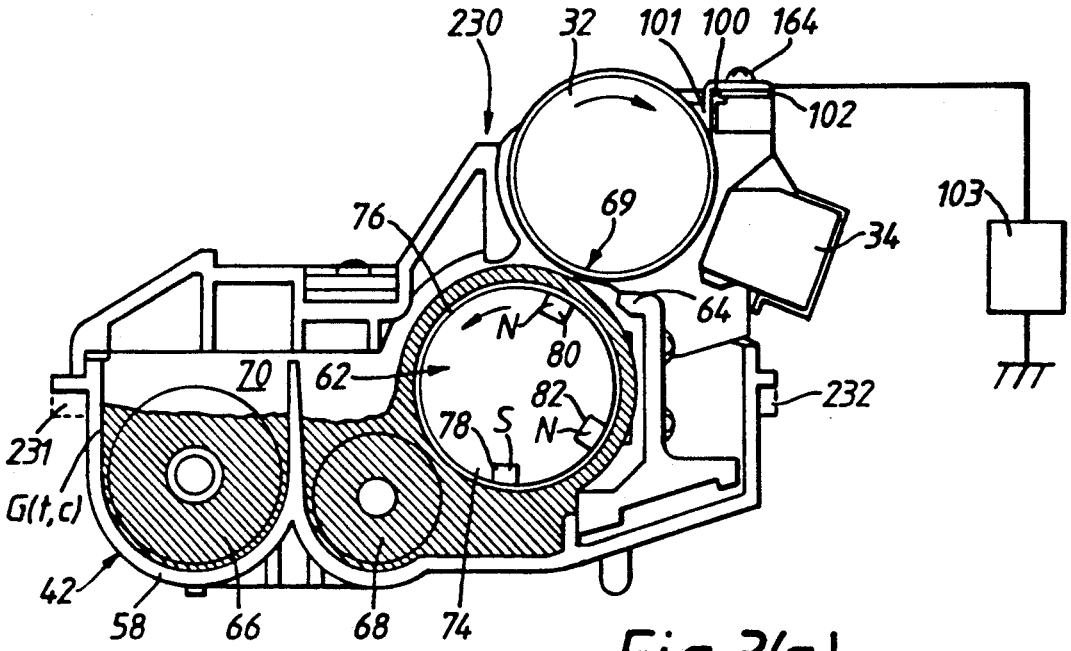
FIG. 3A is a sectional view schematically showing a process unit of the image-forming apparatus according to the present invention.
Figure 3B:
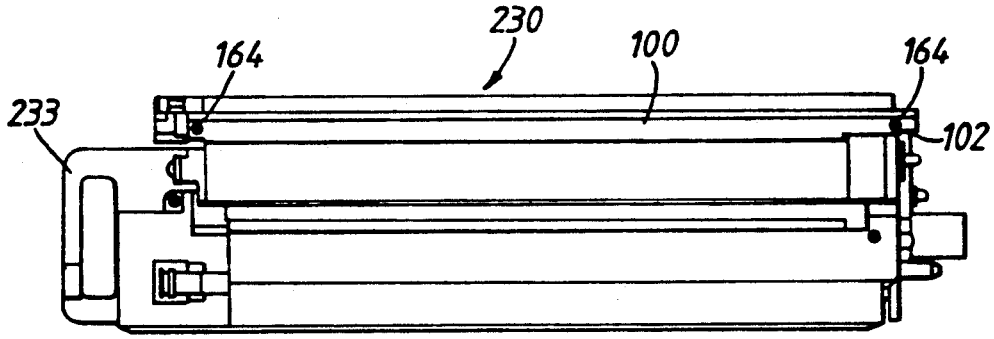
FIG. 3B is a plan view showing the process unit of the image-forming apparatus according to the present invention.

FIG. 3A is a sectional view schematically showing the process unit 230 and FIG. 3B is a plan view showing process unit 230 according to the present invention which has been removed from the printer. Process unit 230 includes a handle 233, to move the process unit outwardly on rails 231 and 232, and utilized to lift process unit 230 from the printer.

As shown in FIG. 3, distributing means 100 includes a conductive brush member 101. Brush member 101 is supported by conductive supporting bar 102 and is attached to housing 58 through supporting bar 102 by fastening means, such as bolts or rivets 164. Further, brush member 101 is electrically connected to the power source 103 through supporting bar 102 to have a potential of a polarity reverse to the polarity of the electrostatic latent image formed on photosensitive drum 32.

Developing device 42 includes developing roller 62, doctor blade 64, stirring conveyor 66, and stirring supplier 68. Doctor blade 64 is located in the region where photosensitive drum 32 is in sliding contact with a magnetic brush of a developing agent on developing roller 62, that is, on the upper-course side of developing position 69 with respect to the rotating direction of developing roller 62. Doctor 64 serves to restrict the thickness of the magnetic brush. Stirring conveyor 66 and stirring supplier 68 are contained in developer storage portion 70 inside housing 58. Stirring conveyer 66 stirs and conveys replenishing toner t from a toner hopper (not shown) to stirring supplier 68. Stirring supplier 68 stirs and supplies developing roller 62 with toner t. In developer storage portion 70 there is stored developing agent G, which is composed of toner (color powder) t and carrier (magnetic powder) c. The toner hopper stocks new toner t and replenishes toner t storage portion 70. Toner t and carrier C are triboelectrically charged by friction with each other or by the action of peripheral equipment such as, developing roller 62, stirring conveyer 66, stirring supplier 68, etc.

Developing, roller 62 includes magnetic roller 74 and sleeve 76. Sleeve 76, which is fitted on roller 74, is rotated in the counterclockwise direction of FIG. 3A.

Magnetic roller 74 includes three pole blocks 78, 80 and 82. Block 78 is a south pole and blocks 80 and 82 are north poles.

A reverse development process is carried out by developing device 42. After transfer of the toner image, residual toner t on photosensitive drum 32 is removed simultaneously with the development of the electrostatic latent image. Thus, drum 32 can enjoy a longer life and the electrophotographic process is simplified. FIGS. 4A to 4D and 5A to 5D show the state of toner particles t on drum 32 and the changes on the surface potential of drum 32 during the process.

Figure 4A:
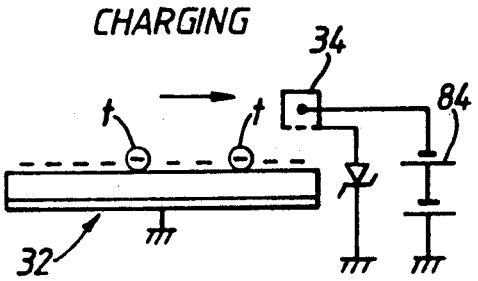
FIGS. 4A to 4D are diagrams illustrating processes of image formation by the apparatus shown in FIG. 1.
Figure 5A:
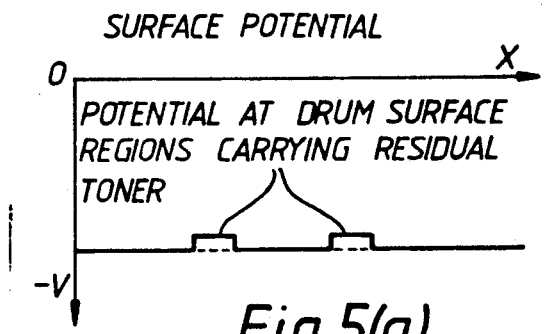
FIGS. 5A to 5D show transitions of the surface potential of a photosensitive drum during the process of image formation by the apparatus of FIG. 1.

As shown in FIGS. 4A and 5A, photosensitive drum 32 is charged to a level of e.g. −600 V (hereinafter referred to as surface potential of drum 32) as main charger 34 is supplied with voltage from power source 84. At the same time, toner particles t remaining on drum 32, without having been transferred from drum 32 to sheet P by the previous copying operation, are charged. At the same time, those portions of drum 32 having residual toner particles t thereon are also charged. The reason for this situation has been made clear by experimentation. In the experiments when toner t was removed by means of a blade, such as a polyurethane blade, the surface potential of the portions of drum 32 having had the residual toner particles thereon, was kept at 80 to 90% of the potential of those drum portions without any residual toner particles.

In the apparatus according to this embodiment, the surface potential of photosensitive drum 32 is made uniform by using a scorotron charger as main charger 34. As mentioned before, therefore, the surface potential of the portions of drum 32, having had the residual toner particles thereon, is only a little lower than that of the portions without the residual toner particles. Practically, such a potential difference is negligible.

Figure 4C:
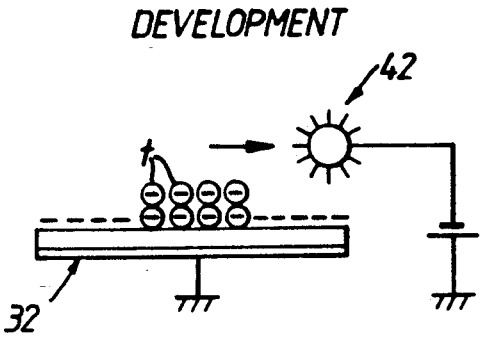
Figure 4B:
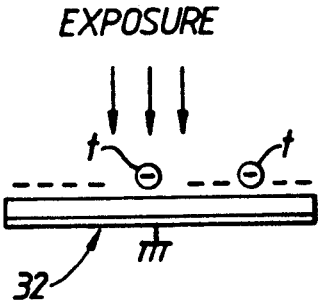
Figure 5C:
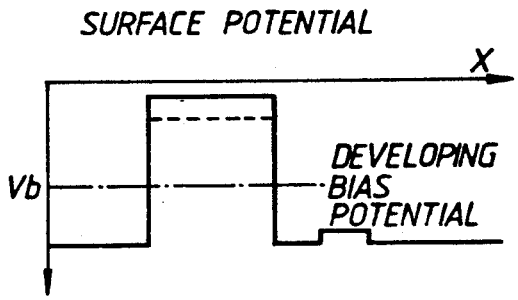
Figure 5B:
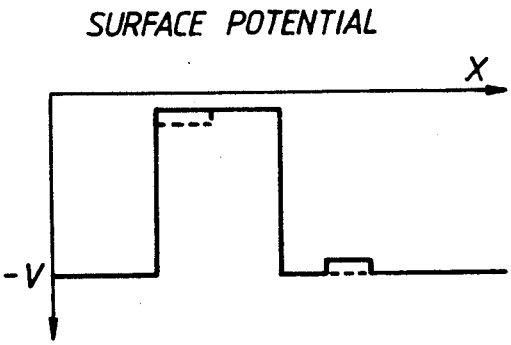

As described above, the surface of photosensitive drum 32 is exposed to laser beam 36 which is modulated on the basis of the dot image data from the host system. By doing this, the surface potential of drum 32 is attenuated. Consequently, the electrostatic latent image is formed on the drum, as shown in FIGS. 4B and 5B.

The electrostatic latent image is developed by developing device 42. More specifically, device 42 supplies toner (colored powder) t to the latent image, thereby developing it into a toner image. At the same time, residual toner particles t, which are not necessary for the formation of the toner image, are removed by means of the developing device, as shown in FIGS. 4C and 5C.

Figure 4D:
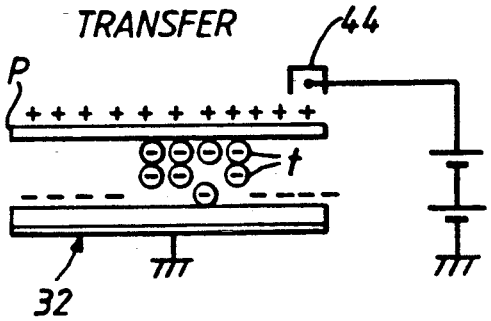
Figure 5D:
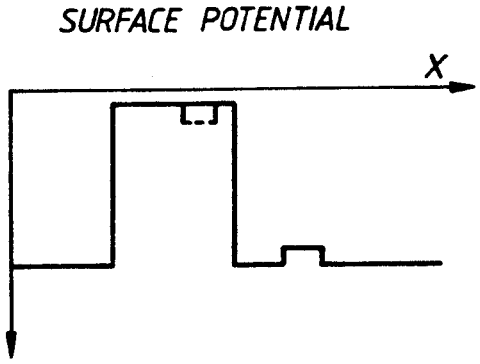

The toner image is transferred to the surface of sheet P by means of transfer charger 44. Namely, a high voltage opposite in polarity to the negatively charged toner is applied by charger 44. As a result, the reverse side of sheet P is subjected to positive corona discharge, so that the sheet is charged positively. Thereupon, the negative toner image on photosensitive drum 32 is attracted to sheet P, as shown in FIGS. 4D and 5D.

The principles conditions, experimental data, etc. on which the present invention is based will now be described.

It is essential to execute the aforementioned process for simultaneous development and cleaning (hereinafter referred to as cleaning-synchronized development process) by the so-called reverse development method. The reason is that toner t and photosentitive drum 32 are charged to the same polarity, so that the polarity of residual toner t can never be inverted by the charging operation of main charger 34.

Moreover, it is important to use a magnetic brush in the reverse development method. Residual toner t is removed by a mechanical force for removal using the magnetic brush of developing agent and an electrical attraction produced by a difference potential between drum 32 and developing roller 62.

It is difficult to make a developing agent that also performs as a cleaner. Materials that operate well as developers do not clean well, and materials that clean well are generally not good developers.

In the case of the reverse developing, toner t is transferred from developing roller 62 to the surface regions of drum 32, which is exposed after the charging process by main charger 34, basically by developing bias potential Vb applied to developing roller 62. While, in the case of cleaning, the residual toner t is attracted from the surface regions of drum 32, which are unexposed, to developing roller 62 basically by the difference potential $|Vo-Vb|$ between surface potential Vo of drum which is charged to by main charger 34 and developing bias potential Vb.

Accordingly, in order to obtain satisfactory image quality, this potential difference $|Vo-Vb|$ must be taken into consideration as an important element of cleaning-synchronized development process.

In this embodiment, drum 32 is an OPC (organic photoconductor) photosensitive drum suitable for negative charging. In consideration of use of a photosensitive drum suitable for positive charging, however, Vo, Vb, and Vo-Vb are given as absolute values.

The image formed by the process corresponding to the preceding revolution of drum 32 appears in the present image on paper sheet P, due to defective cleaning. If different potential $|Vo-Vb|$ is lower than 50 V, it is impossible to perfectly remove residual toner t, due to lack of electrical attraction by the difference potential $|Vo-Vb|$. Thus, the memory attributable to defective cleaning is produced.

If difference potential $|Vo-Vb|$ becomes too high, however, a charge is transferred inversely from developing roller 62 to toner t. As a result, toner t never fails to be charged for the opposite polarity. Thus, if the difference potential $|Vo-Vb|$ becomes higher than 300 V, the image will suffer from fogging.

A carrier with the maximum magnetic force of 50 to 150 emu/g was used as carrier c in developing agent G, and development was performed with main pole 80 of developing roller 62 adjusted to a magnetic flux density of 1,000 gauss. Thereupon, carrier c is adhered to photosensitive drum 32 when different potential $|Vo-Vb|$ is higher than 300 V. Thus, it may be understood that potential $|Vo-Vb|$ should preferably be more than 50 V and less than 300 V.

The present invention is not limited to the above embodiment, and various other changes and modifications may be made within the spirit and scope of the invention.

What is claimed is:

1. An image forming apparatus, including a reusable image carrier and utilizing a developing agent for forming an image on a recording medium, comprising:

means for forming a charged pattern corresponding to the image on the image carrier;

means for simultaneously developing the charged pattern with developing agent into a developed image on the image carrier and removing developing agent remaining on the image carrier from a previous image forming operation from portions of the image carrier other than the developed image;

means for transferring the developed image from the image carrier to the recording medium;

means for distributing any developing agent remaining on the image carrier after transfer of the developed image, the distributing means including a conductive brush member mounted in sliding contact with the image carrier and being electrically biased to a potential of a polarity reverse to the polarity of the pattern formed on the image carrier; and means for mounting at least the image carrier and the distributing means together in the apparatus as a single removable unit.

2. The image forming apparatus of claim 1, wherein the potential is greater than 50 V and less than 300 V.

3. An image forming apparatus, including a reusable image carrier, utilizing a developing agent for forming an image on a recording medium comprising:

means for forming a charged pattern corresponding to the image on the image carrier;

means for simultaneously developing the charged pattern with developing agent into a developed image on the image carrier and removing developing agent remaining on the image carrier for a previous image forming operation from portions of the image carrier other than the developed image;

means for transferring the developed image from the image carrier to the recording medium;

means for distributing any developing agent remaining on the image carrier after transfer of the developed image, said distributing means having a conductive brush member;

housing means for enveloping at least the image carrier and said distributing means together in the apparatus as a single removable unit;

a power source;

a conductive supporting bar, arranged along the image carrier, for supporting said conductive brush member to be in contact with the image carrier and for electrically connecting said conducive brush member to said power source so that said conductive brush member has a potential of a polarity reverse to that of said charged pattern; and fastening means for attaching said conductive brush member through said conductive supporting bar to said housing means.

* * * * *